US008002515B2

(12) United States Patent
Kellock et al.

(10) Patent No.: US 8,002,515 B2
(45) Date of Patent: Aug. 23, 2011

(54) FLOW INHIBITOR OF TURBOMACHINE SHROUD

(75) Inventors: Iain Robertson Kellock, Simpsonville, SC (US); Charles Alan Bulgrin, Avon, IN (US); Tagir Robert Nigmatulin, Moscow (RU); Ralph Chris Bruner, Taylors, SC (US)

(73) Assignee: General Electric Company, Schenectady, NY (US)

( * ) Notice: Subject to any disclaimer, the term of this patent is extended or adjusted under 35 U.S.C. 154(b) by 590 days.

(21) Appl. No.: 12/206,333

(22) Filed: Sep. 8, 2008

(65) Prior Publication Data

US 2010/0061848 A1 Mar. 11, 2010

(51) Int. Cl.
*F03B 11/02* (2006.01)

(52) U.S. Cl. ..... 415/1; 415/108; 415/175; 415/226

(58) Field of Classification Search ..... 415/1, 108, 415/175, 226

See application file for complete search history.

(56) References Cited

U.S. PATENT DOCUMENTS

| | | | | |
|---|---|---|---|---|
| 5,820,336 | A * | 10/1998 | Hashimoto | 415/115 |
| 6,984,106 | B2 * | 1/2006 | Thompson | 415/173.1 |
| 7,338,253 | B2 * | 3/2008 | Nigmatulin | 415/139 |
| 7,445,426 | B1 * | 11/2008 | Matheny et al. | 415/135 |
| 7,811,054 | B2 * | 10/2010 | Eastman et al. | 415/173.1 |
| 2009/0148283 | A1 * | 6/2009 | Mons et al. | 415/209.3 |
| 2009/0208332 | A1 * | 8/2009 | Weinstein et al. | 415/209.3 |
| 2010/0061848 | A1 * | 3/2010 | Kellock et al. | 415/201 |
| 2010/0068041 | A1 * | 3/2010 | Nigmatulin et al. | 415/173.1 |
| 2010/0266399 | A1 * | 10/2010 | Hansen et al. | 415/209.1 |

* cited by examiner

*Primary Examiner* — George Fourson, III
(74) *Attorney, Agent, or Firm* — Cantor Colburn LLP

(57) ABSTRACT

Disclosed is a shroud for a turbomachine including at least one support structure and at least one inner shroud disposed at a gas path of a turbomachine. The at least one inner shroud and the at least one support structure have at least one gap therebetween. The at least one gap alternates between at least one restrictive gap and at least one unrestrictive gap and is capable of creating at least one pressure loss mechanism to reduce a hot gas flow in the at least one gap. Further disclosed is a turbomachine and a method for reducing ingestion of hot gas in a turbomachine.

20 Claims, 3 Drawing Sheets

FLOW INHIBITOR OF TURBOMACHINE SHROUD

BACKGROUND

The subject invention relates generally to turbomachinery. More particularly, the subject invention relates to flow inhibitors for turbomachinery.

A turbomachine, for example, a gas turbine typically includes at least one inner shroud supported in the turbomachine by at least various components including an outer shroud. The inner shroud is located directly downstream of a row of turbine nozzles and is exposed to gas temperatures high enough to require that the inner shroud be actively cooled or damage to the inner shroud would result from the exposure. The outer shroud, however, is typically not actively cooled since it is not directly in the gas path.

Hot gas is often ingested by the turbomachine into an axial gap which is typically between the turbine nozzles and the inner shroud. Hot gas flow entering this gap may, if not stopped or otherwise mitigated, advance to reach the outer shroud and cause damage to the outer shroud. The ingestion is often caused in part by a circumferential pressure gradient primarily resulting from the close proximity of a trailing edge of the nozzles and a forward edge of the inner shroud. The circumferential pressure gradient forces hot gas into the gap.

One measure used to prevent damage to the outer shroud is to inject secondary cooling air from the inner shroud into the gap between the turbine nozzles and the inner shroud to prevent hot gas from reaching the outer shroud. This method, however, decreases performance of the turbomachine, and the art would well receive a structure or method to prevent damage to the outer shroud from hot gas ingestion that does not negatively impact engine performance.

BRIEF DESCRIPTION OF THE INVENTION

According to one aspect of the invention, a shroud for a turbomachine includes at least one support structure, and at least one inner shroud disposed at a gas path of a turbomachine. The at least one inner shroud and the at least one support structure have at least one gap therebetween. The at least one gap alternates between at least one restrictive gap and at least one unrestrictive gap and is capable of creating at least one pressure loss mechanism to reduce a hot gas flow in the at least one gap.

According to another aspect of the invention, a turbomachine includes a plurality of nozzles disposed in a gas path and a plurality of buckets rotatable about a central axis of the turbomachine disposed downstream of the plurality of nozzles. At least one shroud is located radially outboard of the plurality of buckets and includes at least one support structure and at least one inner shroud disposed at the gas path. The at least one inner shroud and the at least one support structure have at least one gap therebetween. The at least one gap alternates between at least one restrictive gap and at least one unrestrictive gap capable of creating at least one pressure loss mechanism to reduce a hot gas flow in the at least one gap.

According to yet another aspect of the invention, a method for reducing ingestion of hot gas in a turbomachine includes flowing hot gas into a gap between at least one inner shroud and at least one support structure and flowing the hot gas in the gap in a circumferential direction relative to a central axis of the turbomachine. A pressure loss is induced in the hot gas in the gap by alternating the gap between at least one restrictive gap and at least one unrestrictive gap, thereby reducing a flow of the hot gas into the gap.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
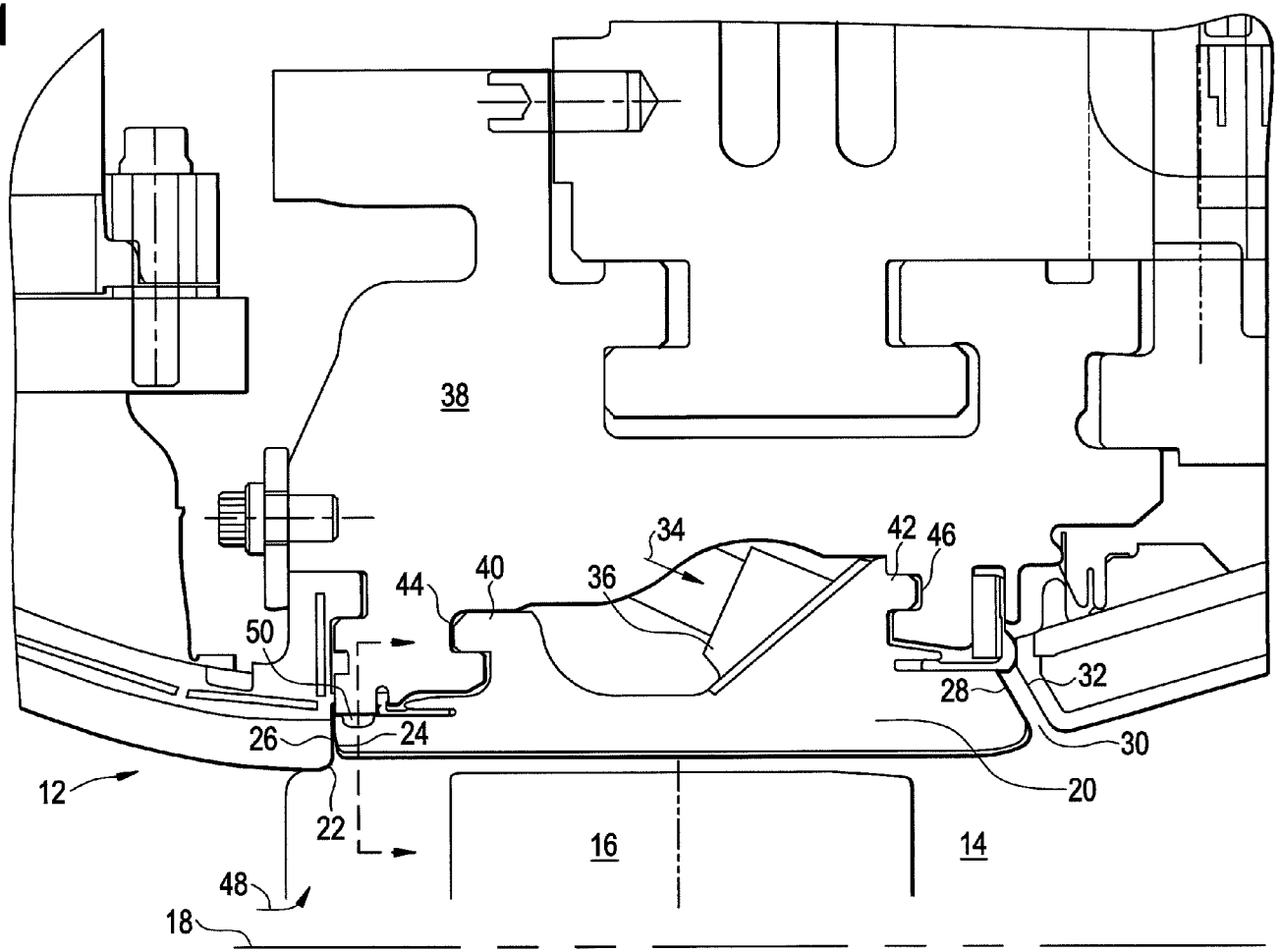
FIG. 1 is a partial cross-sectional view of a turbomachine.

Shown in FIG. 1 is a partial cross section of a turbomachine, in this embodiment a gas turbine 10. The gas turbine 10 includes a plurality of nozzles 12 disposed in a hot gas path 14 upstream of a plurality of buckets 16 which rotate about a central axis 18 of the gas turbine 10. At least one inner shroud 20 is disposed radially outboard of the plurality of buckets 16 and at least partially defines the hot gas path 14. The at least one inner shroud 20 is disposed directly downstream of the plurality of nozzles 12, with a forward gap 22 between a forward inner shroud edge 24 and an aft nozzle edge 26. Similarly, an aft inner shroud edge 28 may have a rear gap 30 to a forward nozzle edge 32. The at least one inner shroud 20 is actively cooled by, in some embodiments, injecting secondary cooling flow 34 into a plurality of cooling channels 36 in the at least one inner shroud 20. The at least one inner shroud 20 is supported in the gas turbine 10 by at least one outer shroud 38. In some embodiments, the at least one inner shroud 20 includes at least one forward hook 40 and at least one aft hook 42 which are inserted into corresponding at least one forward groove 44 and at least one aft groove 46 in the at least one outer shroud 38 to secure the at least one inner shroud 20 to the at least one outer shroud 38.

Figure 2:
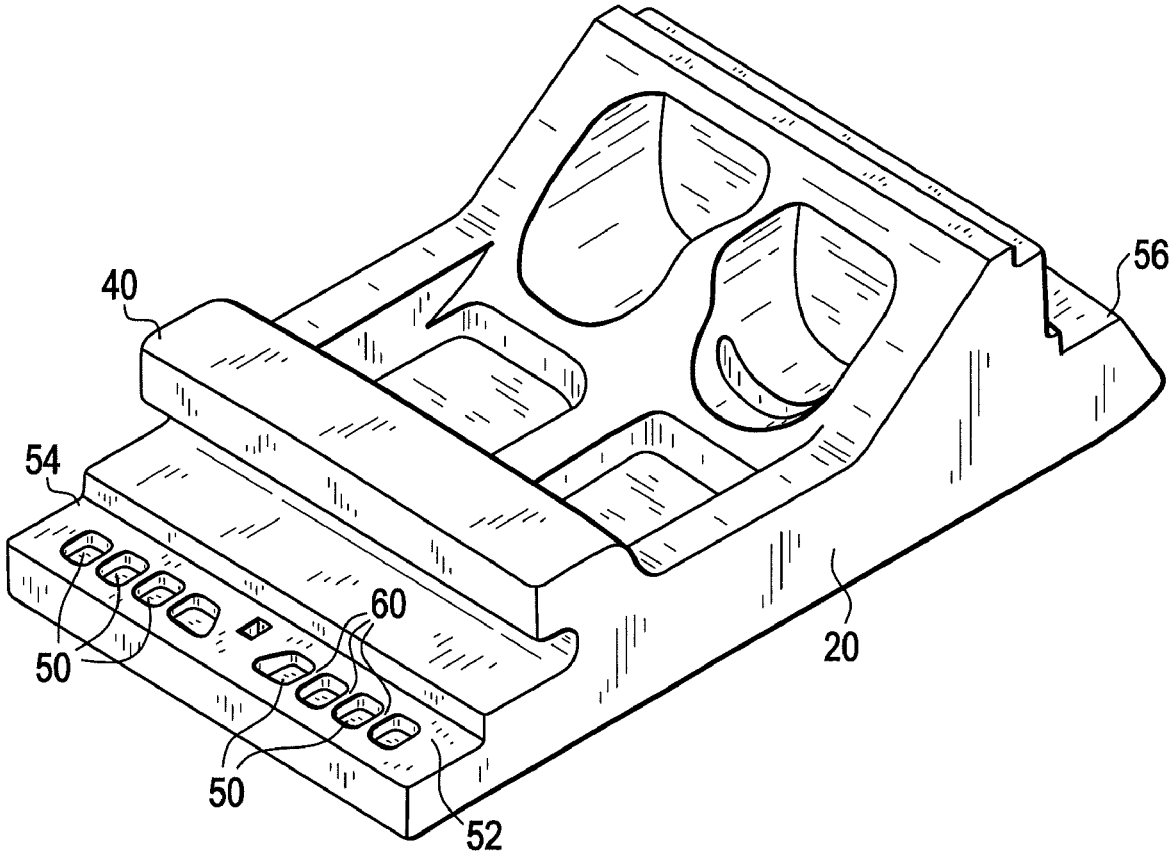
FIG. 2 is a perspective view of an inner shroud.

During operation of the gas turbine 10, hot gas (shown by arrows 48) from the hot gas path 14 may be ingested into the forward gap 22 and/or the rear gap 30. The hot gas 48 flows along the forward gap 22 and or the rear gap 30 in a radial direction and in a circumferential direction. If allowed to flow throughout the forward gap 22 and/or the rear gap 30, the hot gas 48 will damage the at least one outer shroud 38. As shown in FIG. 2, to prevent hot gas 48 flow throughout the forward gap 22 and/or the rear gap 30, a plurality of labyrinth pockets 50 are disposed in the at least one inner shroud 20. In the embodiment of FIG. 2, the plurality of labyrinth pockets 50 are disposed at an outer surface 52 of a forward land 54 of the at least one inner shroud 20. For the sake of brevity, the plurality of labyrinth pockets 50 disposed at the forward land 54 will be described in detail herein, but it is to be appreciated that labyrinth pockets 50 may be disposed at the outer surface 52 of a rear land 56 to prevent hot gas 48 flow throughout the rear gap 30 as will be described below regarding the forward gap 22.

Figure 3:
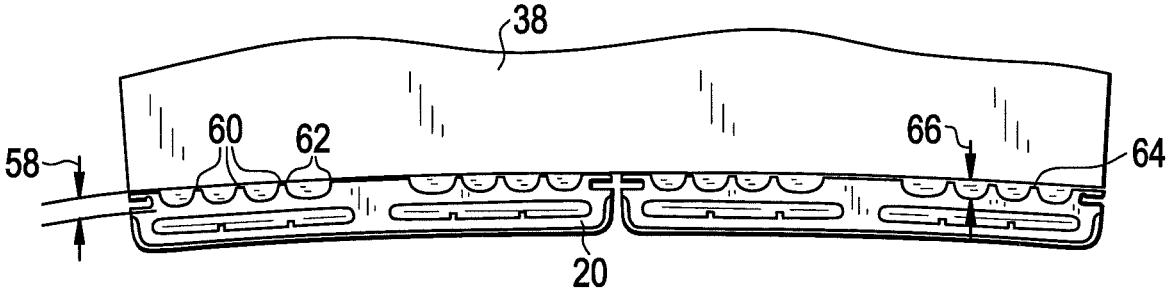
FIG. 3 is a partial circumferential cross-sectional view of the turbomachine.

The plurality of labyrinth pockets 50 are arranged in a circumferentially-extending array around the at least one inner shroud 20. As best shown in FIG. 3, the plurality of pockets 50 extend to a depth 58 from the outer surface 52 with a ridge 60 disposed between adjacent labyrinth pockets 50 of the plurality of labyrinth pockets 50, with sharp edges 62 defining locations where the ridges 60 meet the plurality labyrinth pockets 50. Assembled into the gas turbine 10, as shown in FIG. 3, the inner shroud 20 and the outer shroud 38 define gaps therebetween that alternate in a circumferential direction between a restrictive gap 64 at each ridge 60 and an unrestrictive gap 66 at each labyrinth pocket 50. The alternating restrictive gaps 64 and unrestrictive gaps 66, as well as the sharp edges 62, create a series of pressure loss mechanisms between the inner shroud 20 and the outer shroud 38. The pressure loss is caused by the hot gas 48 flowing across the sharp edges 62 and experiencing abrupt changes in flow area between the restrictive gaps 64 and unrestrictive gaps 66 which results in turbulence and recirculation of the hot gas 48. The pressure losses reduce the circumferential flow of hot gas 48 in the forward gap 22. The circumferential flow of hot gas 48 is driven by a circumferential pressure gradient, so the series of pressure loss mechanisms inhibits the hot gas 48 flow in the gap 22.

The plurality of labyrinth pockets 50 further provide a cooling mechanism for the hot gas 48 which does enter the gap 22. The hot gas 48 is turbulated within each labyrinth pocket 50 thus increasing a convective heat transfer between the hot gas 48 and the actively cooled inner shroud 20. Further, the plurality of labyrinth pockets 50 increase a surface area of the inner shroud 20 to which the hot gas 48 is exposed, thus lowering the temperature of the hot gas 48.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A shroud for a turbomachine comprising:

at least one support structure;

at least one inner shroud disposed at a gas path of a turbomachine; and at least one gap between the at least one inner shroud and the at least one support structure, the at least one gap alternating between at least one restrictive gap and at least one unrestrictive gap capable of creating at least one pressure loss mechanism to reduce a hot gas flow in the at least one gap.

2. The shroud of claim 1 wherein the at least one restrictive gap and the at least one unrestrictive gap alternate in a circumferential direction around the at least one inner shroud.

3. The shroud of claim 1 wherein the at least one inner shroud includes a plurality of pockets disposed at the at least one gap to define the at least one restrictive gap and the at least one unrestrictive gap.

4. The shroud of claim 3 wherein the plurality of pockets is disposed at an axial land of the at least one inner shroud.

5. The shroud of claim 3 wherein the plurality of pockets are disposed circumferentially around the at least one inner shroud.

6. The shroud of claim 5 wherein the plurality of pockets are capable of reducing a circumferential flow of the hot gas flow in the at least one gap.

7. The shroud of claim 3 wherein the plurality of pockets are capable of reducing a temperature of the hot gas flow in the at least one gap.

8. A turbomachine comprising:

a plurality of nozzles disposed in a gas path;

a plurality of buckets rotatable about a central axis of the turbomachine, the plurality of buckets disposed downstream of the plurality of nozzles; and at least one shroud disposed radially outboard of the plurality of buckets, the at least one shroud including:

at least one support structure;

at least one inner shroud disposed at the gas path; and at least one gap between the at least one inner shroud and the at least one support structure, the at least one gap alternating between at least one restrictive gap and at least one unrestrictive gap capable of creating at least one pressure loss mechanism to reduce a hot gas flow in the at least one gap.

9. The turbomachine of claim 8 wherein the at least one restrictive gap and the at least one unrestrictive gap alternate in a circumferential direction around the at least one shroud.

10. The turbomachine of claim 8 wherein the at least one inner shroud includes a plurality of pockets disposed at the at least one gap to define the at least one restrictive gap and the at least one unrestrictive gap.

11. The turbomachine of claim 10 wherein the plurality of pockets is disposed at an axial land of the at least one inner shroud.

12. The turbomachine of claim 10 wherein the plurality of pockets are disposed circumferentially around the at least one inner shroud.

13. The turbomachine of claim 12 wherein the plurality of pockets are capable of reducing a circumferential flow of the hot gas flow in the at least one gap.

14. The turbomachine of claim 10 wherein the plurality of pockets are capable of reducing a temperature of the hot gas flow in the at least one gap.

15. A method for reducing ingestion of hot gas in a turbomachine comprising:

flowing hot gas into a gap between at least one inner shroud and at least one support structure;

flowing the hot gas in the gap in a circumferential direction relative to a central axis of the turbomachine; and inducing a pressure loss in the hot gas in the gap via alternating the gap between at least one restrictive gap and at least one unrestrictive gap.

16. The method of claim 15 wherein inducing a pressure loss in the hot gas includes flowing the hot gas across a plurality of pockets in the inner shroud.

17. The method of claim 16 wherein the hot gas is flowed across the plurality of pockets in a circumferential direction.

18. The method of claim 15 including reducing a temperature of the hot gas.

19. The method of claim 18 wherein the temperature of the hot gas is reduced by turbulating the hot gas thereby increasing convective heat transfer between the hot gas and the inner shroud.

20. The method of claim 19 wherein the hot gas is turbulated by flowing the hot gas across a plurality of pockets in the inner shroud.

* * * * *